US007669731B2

(12) United States Patent
Hewett

(10) Patent No.: US 7,669,731 B2
(45) Date of Patent: Mar. 2, 2010

(54) MOBILE HEALTHCARE PRODUCT DISPENSER

(76) Inventor: Christopher B. Hewett, 605 W. Main St., Suite #004, Aspen, CO (US) 81611

( * ) Notice: Subject to any disclaimer, the term of this patent is extended or adjusted under 35 U.S.C. 154(b) by 1628 days.

(21) Appl. No.: 10/071,902

(22) Filed: Feb. 8, 2002

(65) Prior Publication Data

US 2003/0150868 A1 Aug. 14, 2003

(51) Int. Cl.

| | |
|---|---|
| ***B65D 83/00*** | (2006.01) |
| ***B65H 3/58*** | (2006.01) |
| ***B65H 1/00*** | (2006.01) |
| ***A47F 1/00*** | (2006.01) |

(52) U.S. Cl. ..... 221/65; 221/34; 221/63; 221/47; 221/48; 221/45; 221/97; 221/102

(58) Field of Classification Search ..... 221/65, 221/34, 63, 47, 48, 45, 97, 102
See application file for complete search history.

(56) References Cited

U.S. PATENT DOCUMENTS

| | | | | |
|---|---|---|---|---|
| 1,988,939 | A | 1/1935 | Craig | |
| 2,566,016 | A | 8/1951 | Cochran | |
| 2,841,275 | A * | 7/1958 | Schwimmer et. al. | 206/233 |
| 2,915,218 | A | 12/1959 | Rosenman et al. | |
| 3,026,399 | A * | 3/1962 | Lighter | 219/405 |
| 3,072,245 | A * | 1/1963 | Faltin | 224/277 |
| 3,089,586 | A * | 5/1963 | Cole | 206/216 |
| 3,089,597 | A * | 5/1963 | Kaplan | 224/400 |
| 3,095,087 | A | 6/1963 | Yates | |
| 3,141,569 | A | 7/1964 | Hanson | |
| 3,206,999 | A * | 9/1965 | Roth | 74/511 R |
| 3,221,928 | A | 12/1965 | Horn | |
| 3,235,196 | A | 2/1966 | Platt | |
| 3,270,938 | A * | 9/1966 | Rhinegold | 229/101 |
| 3,331,498 | A * | 7/1967 | Davies | 206/494 |
| 3,372,837 | A | 3/1968 | Neumann | |
| 3,385,073 | A | 5/1968 | Snelling | |
| 3,458,095 | A * | 7/1969 | Stall | 224/540 |
| 3,487,769 | A | 1/1970 | Dixon | |
| 3,492,831 | A | 2/1970 | Maurer et al. | |
| 3,845,858 | A | 11/1974 | Jenkins | |
| 3,956,778 | A * | 5/1976 | Tanaka | 4/144.1 |
| 4,151,910 | A | 5/1979 | Yasur | |
| 4,553,275 | A * | 11/1985 | Goldstein | 4/605 |
| 4,790,436 | A | 12/1988 | Nakamura | |
| 4,879,442 | A * | 11/1989 | Giovine | 206/233 |
| 4,919,302 | A | 4/1990 | McPherson | |
| 4,955,505 | A | 9/1990 | Battaglia | |
| D312,934 | S | 12/1990 | Shapland et al. | |

(Continued)

FOREIGN PATENT DOCUMENTS

| | | |
|---|---|---|
| DE | 42 34 787 | 4/1994 |

(Continued)

*Primary Examiner*—Patrick Mackey
*Assistant Examiner*—Michael E. Butler
(74) *Attorney, Agent, or Firm*—Buchanan Ingersoll & Rooney PC

(57) ABSTRACT

A dispenser for dispensing healthcare products comprising at least one dispenser section having at least one dispensing orifice and one disposal section having a disposal opening. The disposal section has fully compressed and fully uncompressed positions and is capable of remaining positioned in any position between the fully compressed and uncompressed positions.

10 Claims, 5 Drawing Sheets

U.S. PATENT DOCUMENTS

| | | | | |
|---|---|---|---|---|
| 5,007,531 | A | 4/1991 | Lighten | |
| 5,013,099 | A | 5/1991 | Styles et al. | |
| 5,048,582 | A | 9/1991 | Whitfield | |
| 5,054,612 | A | 10/1991 | Meyer, Jr. | |
| 5,076,465 | A | 12/1991 | Lawson | |
| 5,111,626 | A | 5/1992 | Fortune | |
| 5,127,545 | A | 7/1992 | French | |
| 5,129,545 | A | 7/1992 | Parks | |
| 5,375,928 | A * | 12/1994 | Yarng et al. | 383/24 |
| 5,460,013 | A | 10/1995 | Thomsen | |
| 5,669,085 | A * | 9/1997 | Wilson | 4/605 |
| 5,803,249 | A * | 9/1998 | Harsanyi, Jr. et al. | 206/233 |
| 5,868,227 | A | 2/1999 | Garcia | |
| 5,938,094 | A | 8/1999 | Forhan et al. | |
| 5,971,142 | A | 10/1999 | Jones | |
| 6,073,899 | A | 6/2000 | Omrani | |
| 6,129,239 | A | 10/2000 | Fukazawa | |
| 6,164,442 | A | 12/2000 | Stravitz | |
| 6,202,224 | B1 * | 3/2001 | Freeman | 4/144.2 |
| 6,315,151 | B1 | 11/2001 | Hupp et al. | |
| 6,364,156 | B1 * | 4/2002 | Smith et al. | 221/46 |
| 6,371,296 | B1 | 4/2002 | Rumbough | |
| 6,375,928 | B1 * | 4/2002 | Rathjen et al. | 424/9.1 |
| 6,431,360 | B1 | 8/2002 | Julius | |
| 6,439,386 | B1 * | 8/2002 | Sauer et al. | 206/494 |
| 6,588,626 | B2 | 7/2003 | Sauer et al. | |
| 2002/0092789 | A1 | 7/2002 | Sauer et al. | |
| 2002/0121451 | A1 | 9/2002 | Subramanian et al. | |
| 2003/0234257 | A1 * | 12/2003 | Tumlinson | 221/34 |

FOREIGN PATENT DOCUMENTS

| | | |
|---|---|---|
| FR | 2 315 069 | 1/1977 |
| GB | 464373 | 4/1937 |
| GB | 2 211 922 | 7/1989 |
| GB | 2 275 098 | 8/1994 |
| GB | 2 357 484 | 6/2001 |
| JP | 1-139378 | 5/1989 |
| JP | 8-258614 | 10/1996 |

* cited by examiner

MOBILE HEALTHCARE PRODUCT DISPENSER

FIELD OF INVENTION

This invention relates generally to the field of healthcare product dispensing, and more particularly is a mobile and convenient dispenser and disposal unit for use in providing a supply of healthcare products to be used by people.

BACKGROUND OF THE INVENTION

In the past, people have typically obtained their healthcare supplies from units that only dispense, such as tissues dispensed from cardboard boxes. These dispensers do not typically include a disposal unit, thereby necessitating use of the dispenser supplies near a trash receptacle or requiring the user to carry the used, and possibly unsanitary, healthcare products, such as tissues. Also, some users may simply leave the used supplies next to the dispenser resulting in unsanitary, messy and unsightly conditions. To alleviate this problem, others have created dispensers that are attached or incorporated with the dispenser; however, joint units are bulky.

A number of devices have been designed for both dispensing supplies and disposing thereof after use. Most such devices have fixed dispensing and disposal unit volumes, such as described by Neumann in U.S. Pat. No. 3,372,837 and Meyer, Jr. in U.S. Pat. No. 5,054,612. These devices are bulky and require additional space since they have fixed dispensing and disposal volumes; thereby rendering them less likely to fit in small areas and requiring more space on retailer shelves. Certain other devices share space between the dispensing and disposal sections, such as those described by Horn in U.S. Pat. No. 3,221,928 and Parks in U.S. Pat. No. 5,129,545. As tissues are dispensed from a fixed volume in these devices, space is vacated for the storage of the used tissues. In addition to the fixed volume problems mentioned above, this approach is problematic because the volume emptied by the removal of such supplies is not likely equal to the volume required to dispose of the used supplies. Accordingly, used supplies either do not fit into the disposal section, or more likely, additional volume must be allowed for in the design of the device, thereby resulting in a larger device that creates space problems. One device described by McPherson in U.S. Pat. No. 4,919,302 addresses these concerns by adding a collapsible disposal unit; however, this addresses only the marketing shelf space issue and upon expansion of the fixed volume disposal section the same space issues and problems arise as with the fixed volume dispensers.

As mentioned, healthcare product dispensing technologies, namely tissue dispensing technologies, are fairly well developed; however, existing technologies do not maximize the effective use of such technologies. Further, existing dispensers do not provide convenient and space efficient disposal mechanisms. As a result, significant improvement can still be made in the area of healthcare product dispensing and waste handling and disposal.

It is the primary object of the present invention to enable people to dispense, use and dispose of healthcare products from a single dispensing and disposal device that uses a minimum amount of store shelf space and user space. Another object of the invention is to permit people to take advantage of the convenient and compact dispenser to conveniently and hygienically use healthcare products in environments they may not otherwise use the products, for example, in an automobile, next to a swimming pool, at the beach or in other mobile, outside or non-home environments. Another object of the invention is to make the disposal of used healthcare products easier by including a disposal device which permits easy and convenient disposal of used healthcare products by the person.

SUMMARY OF THE INVENTION

The present invention is a dispenser comprised of a healthcare product dispenser section and a disposal section to permit convenient disposal of the waste products. The disposal section is constructed such that it may be almost entirely collapsed, fully expanded or opened to an intermediate position. As a result of the device, people can use and dispose of healthcare products with a single dispenser, thereby permitting greater cleanliness and convenient use of the invention in a variety of environments.

The size and shape specifications of the healthcare products and dispenser can be varied and they can be positioned in a variety of arrangements. In one embodiment, the products are heavy-duty tissues dispensed from a cartridge, either disposable or refillable, out of the bottom of the dispenser section of the invention and the disposal section has side walls that are an accordion-like shape, thereby permitting the disposal section to be expanded and contracted by the user into fully compressed, uncompressed and intermediate positions. In another embodiment, the invention is a single integrally constructed unit with dispenser and disposal sections and the entire dispenser invention is disposable for user convenience.

DETAILED DESCRIPTION

Figure 1A:
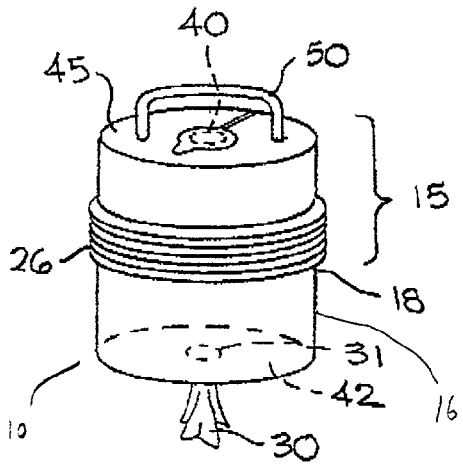
FIG. 1A is a perspective view of an embodiment of the present invention, in its closed/compressed state.
Figure 1B:
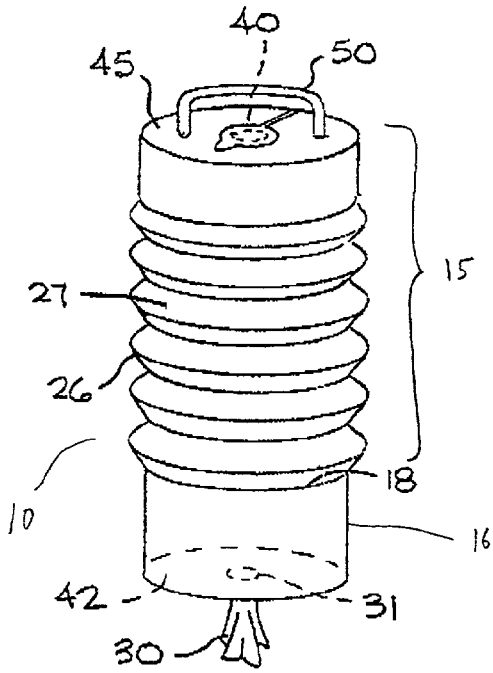
FIG. 1B is a perspective view of FIG. 1A, in its open or uncompressed state.
Figure 2A:
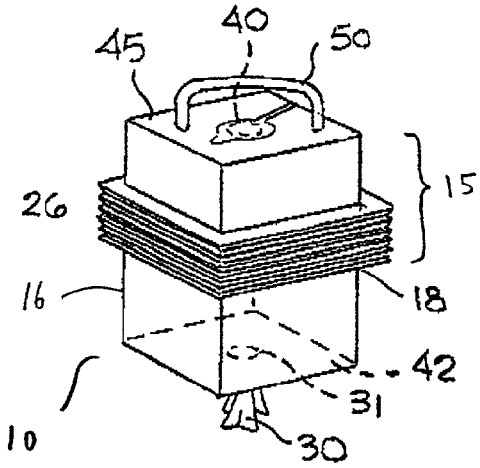
FIG. 2A is a perspective view of an embodiment of the present invention in its closed/compressed state.
Figure 2B:
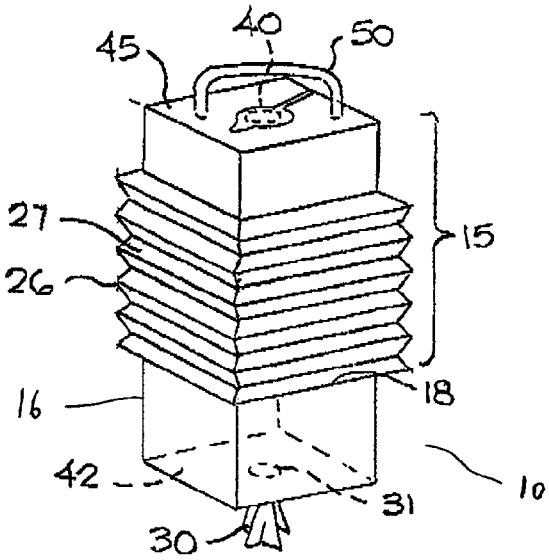
FIG. 2B is a perspective view of FIG. 2A in its open/uncompressed state.

As illustrated in the perspective of FIGS. 1A, 1B, 2A and 2B a dispenser 10 is shown having a generally vertical configuration, although the dispenser can easily be used horizontally and other and different exterior configurations may be used as desired as demonstrated in part in the differing cylindrical shape shown in FIGS. 1A and 1B, and rectangular shape shown in FIGS. 2A and 2B. Dispenser 10 is comprised of two major sections, a dispenser section 16 separated from a disposal section 15 by the dispenser section top 18 and/or disposal section bottom 18. Dispenser section 16 defines a volume to house a supply of tissues 30 that can be pulled through a dispensing orifice 31 defined in the bottom wall 42 of the dispenser 10 in a "pop out" manner well known in the prior art. The tissues may either be sealed into a disposable dispenser section 16 or refilled with a tissue cartridge as shown and described in FIG. 7. The bottom wall 42 is connected to a top wall 45 of the body by a side wall which includes a pleat 26.

The disposal section 15 defines a refuse volume 27 for receiving used tissues. Used tissues are inserted into the refuse volume 27 through a disposal orifice 40 located on the top wall 45 of the disposal section 15. The refuse volume 27 can be increased or decreased by expanding or contracting the flexible bellows 26 of the disposal section 15. The disposal volume 27 is shown at its minimum in FIGS. 1A and 2A where the flexible bellows 26 are compressed and at its maximum volume in FIGS. 1B and 2B where the flexible bellows 26 are uncompressed. The flexible bellows 26 can be made from any material that provides flexible movement with sufficient rigidity to hold its shape, such as plastic, rubber or cardboard.

The dispenser 10 preferably is provided with an elongated element in the form of a handle 50 to permit easy carrying; however, it should be understood that other carrying or fastening techniques may be employed as well such as a longer elongated element in the form of a cord or rope or a sliding eyelet and bolt fastening apparatus allowing the dispensers to be removably secured.

Figure 3:
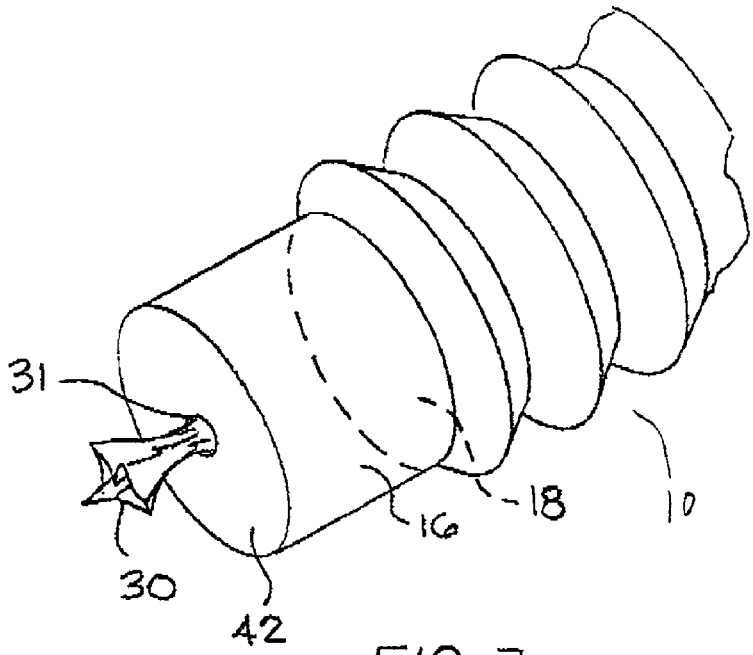
FIG. 3 is a perspective view of the dispensing end of the invention depicted in FIGS. 1A and 1B.

The dispenser section 16 is shown in greater detail in the perspective of FIG. 3. In this embodiment the dispenser section 16 is a disposable unit in which the tissues 30 are prepackaged inside the dispenser volume for removal through the dispensing orifice 31. Upon purchase of the dispenser 10 or installation of a new dispenser section 16 with a fresh supply of tissues 30 the dispensing orifice 31 is covered with a removable seal to keep the tissues 30 clean and dry.

Figure 4:
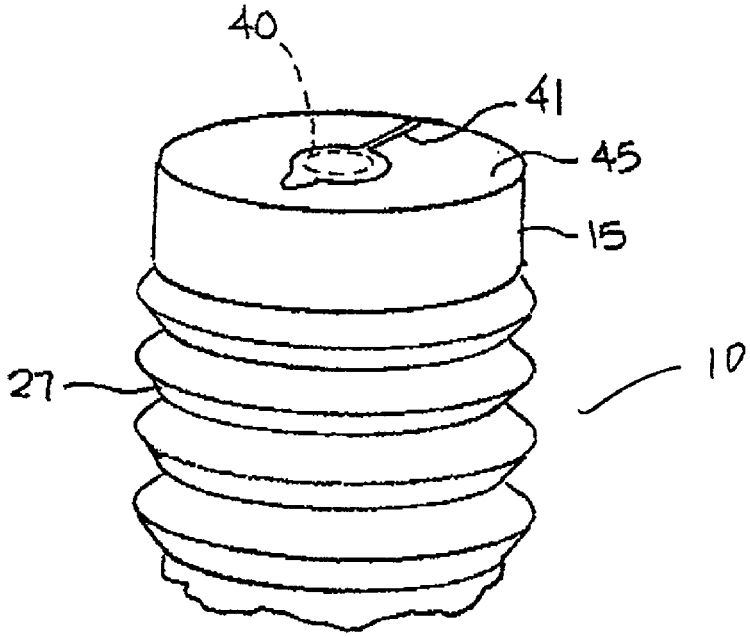
FIG. 4 is a perspective view of the disposal end of the invention depicted in FIGS. 1A and 1B.

The disposal section 15 is shown in greater detail in the perspective of FIG. 4. In this embodiment the dispenser section 15 has a disposal orifice 40 in the top wall 45 of the disposal section 15 permitting used tissues to be placed in the refuse volume 27. The disposal orifice 40 can also be covered by an optional insert plug 41 to shelter the tissue refuse from the outside atmosphere.

Figure 5A:
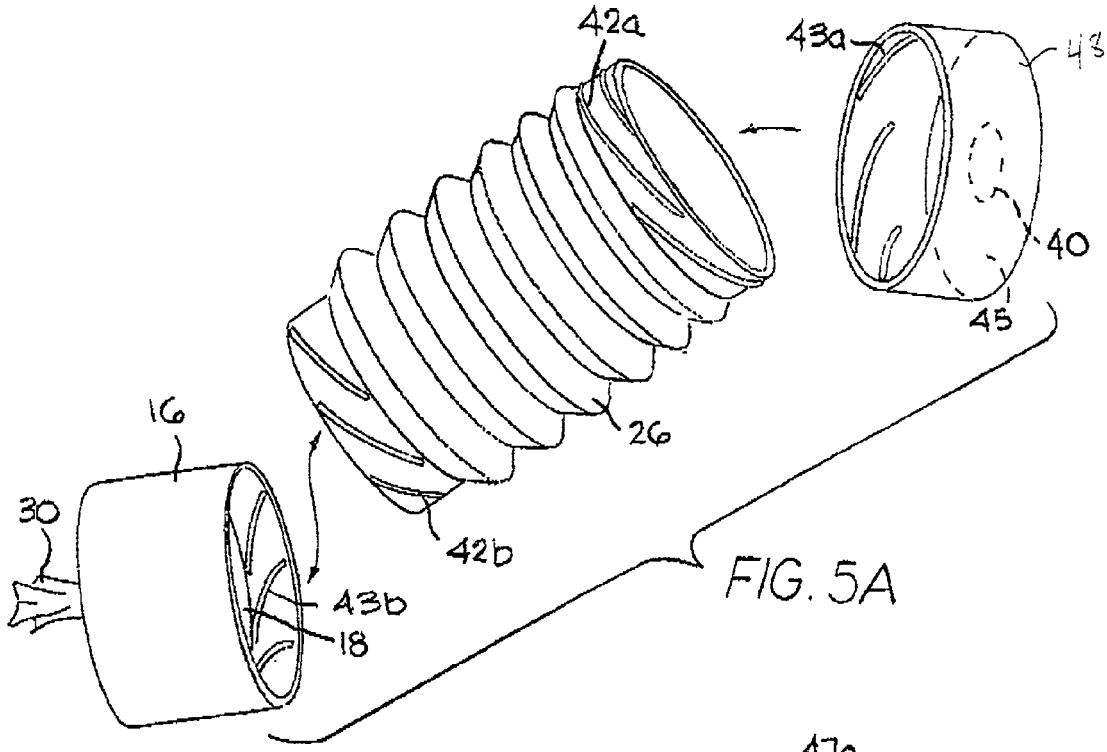
FIGS. 5A and 5B are perspective views of the invention being depicted in FIGS. 1A and 1B, parts being broken away for clarity.
Figure 5B:
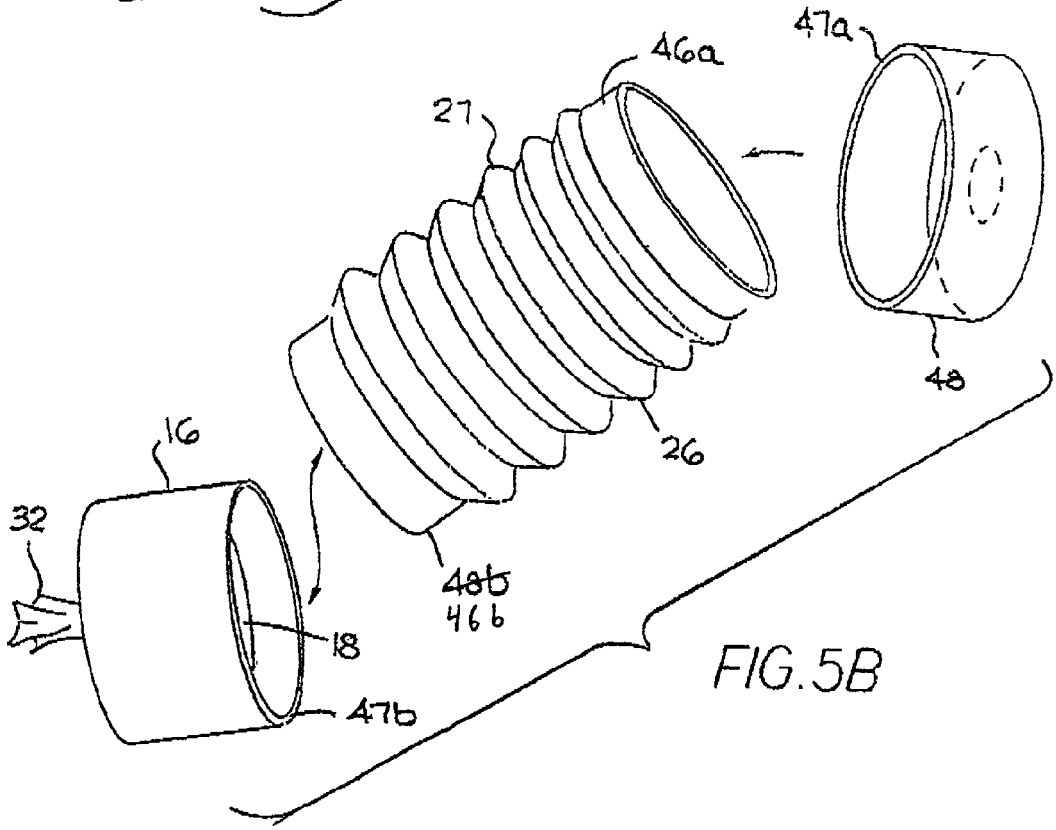
Figure 6A:
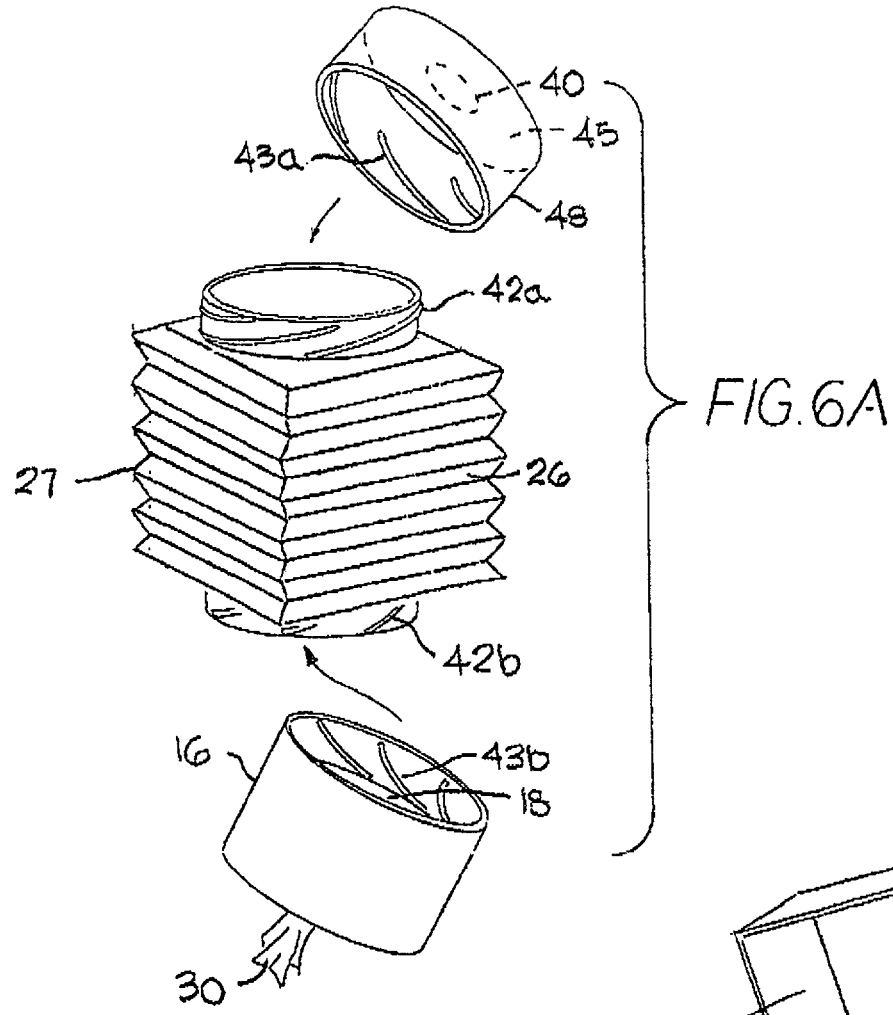
FIGS. 6A and 6B are perspective views of an embodiment of the invention depicted in FIGS. 2A and 2B, parts being broken away for clarity.
Figure 6B:
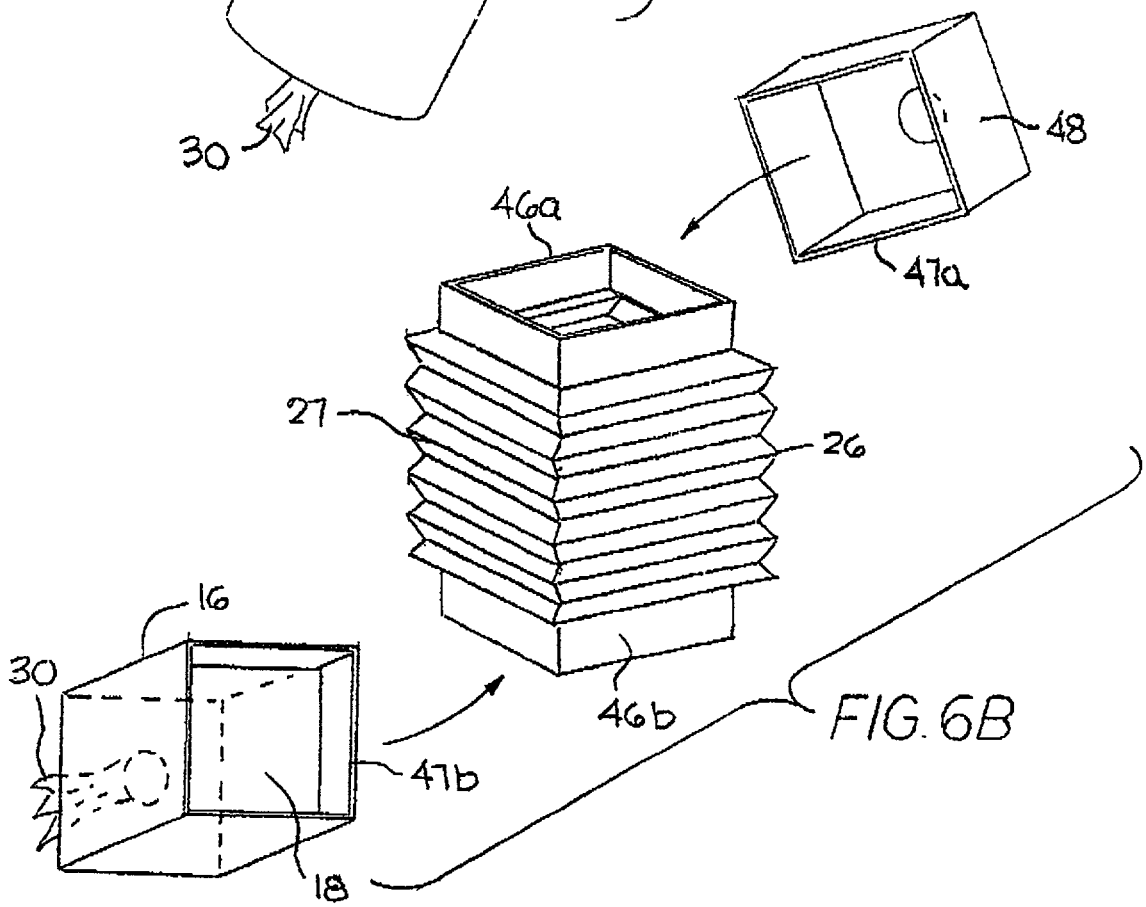

In one embodiment of the dispenser 10, depicted in FIGS. 5A, 5B, 6A and 6B the dispenser section 16 and the disposal lid 48 are removable from the dispenser 10. The flexible bellows 26 section has connecting ends. In FIGS. 5A and 6A, the disposal cap connecting end 42*a* and dispenser section end 42*b* are threaded to mate, respectively, with the disposal lid threads 43*a* and dispenser section threads 43*b*. In FIGS. 5B and 6B, the disposal cap connecting end 46*a* and dispenser section end 46*b* are formed to fit together either by adhesion or fastening means, such as glue or snaps, with the disposal lip 47*a* and dispenser section lip 47*b*. Removal of the dispenser section 16 permits the user to resupply tissues 30 by attaching a new dispenser section 16. Removal of the disposal lid 48 or the dispenser section 16 permits the user to empty and/or clean the refuse volume 27.

Figure 7:
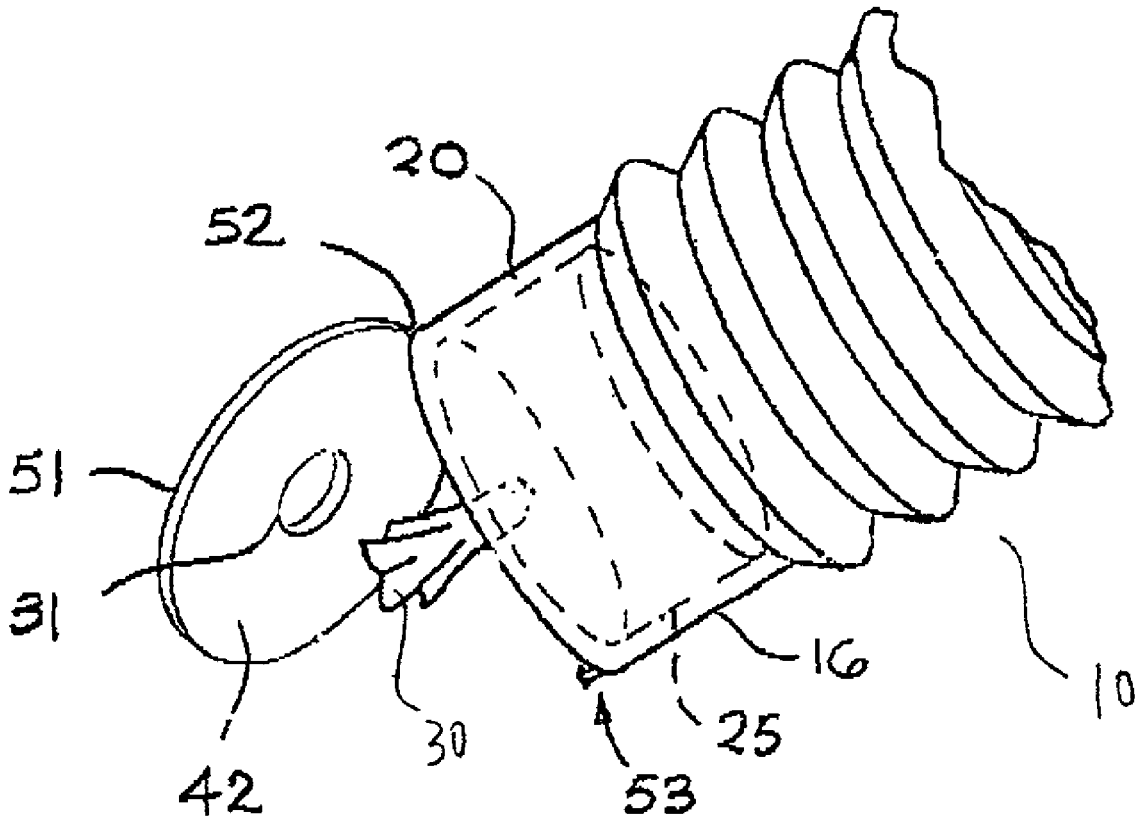
FIG. 7 is a perspective view like that of FIGS. 1A and 1B depicting another embodiment of the present invention, parts broken away for clarity.

In another embodiment of the dispenser 10, depicted in FIG. 7, the dispenser section 16 defines a dispensing volume 20 adapted to removably house and secure a tissue cartridge 25. The tissue cartridge 25 is secured by fitting snugly into the dispensing volume 20 or alternatively by using clips or other restraining devices. The tissue cartridge 25 contains a multiplicity of tissues 30 that can be pulled through the dispensing orifice 31 defined in the bottom wall 42 of the dispenser section 16. Access to the dispensing volume 20 is provided by a pivotable door 51 forming all of or a portion of the bottom wall 42 of the dispenser section 16. The door 51 is mounted to the disposal section 16 by hinges 52 and is secured in a closed position by a latch mechanism 53 positioned opposite the hinges 52. When the tissues 30 in a tissue cartridge 25 are exhausted, it may easily be replaced with a new tissue cartridge 25.

The preceding description of the invention has shown and described certain embodiments thereof; however, it is intended by way of illustration and example only and not by way of limitation. Those skilled in the art should understand that various changes, omissions and additions may be made to the invention without departing from the spirit and scope of the invention.

I claim:

1. A method of providing tissues comprising the steps of:

A) providing a body forming a tissue dispenser having a tissue dispenser section containing tissues to be dispensed and a disposal section for receiving used tissues, the tissue dispenser section being separated from the tissue disposal section by a wall forming a bottom of the tissue disposal section and a top of the tissue dispensing section, and having a tissue dispensing orifice; the tissue disposal section having a tissue disposing orifice; a portion of the body defining the tissue disposal section being expandable from a collapsed state to enlarge the tissue disposal section;

B) mounting the body above floor level such that the tissue dispensing orifice faces downwardly, and the tissue disposing orifice faces upwardly away from the dispensing orifice and is accessible for insertion of used tissues;

C) expanding the tissue disposal section for enlarging an internal volume thereof to provide space for used tissues, wherein a size of the tissue disposing orifice remains the same during the expanding step, and wherein the tissue disposing orifice and the tissue dispensing orifice are moved away from one another during the expanding step;

D) removing tissues through the tissue dispensing orifice in the same direction as the expansion of the tissue disposal section; and E) inserting used tissues into the tissue disposal section through the tissue disposing orifice at an upper portion of the body situated opposite the tissue dispensing orifice in the direction of expansion.

2. The method according to claim 1 wherein step C comprises expanding a pleat which defines the tissue disposal section and extends completely around the periphery of the body.

3. The method according to claim 2 wherein the portion of the body defining the tissue disposal section includes a plurality of the pleats arranged in accordion fashion, each pleat extending completely around the periphery of the body; step C comprising periodically expanding the pleats as the tissue disposal section becomes full of used tissues.

4. The method according to claim 1 wherein step B comprises suspending an upper portion of the body.

5. The method according to claim 1 wherein step C comprises expanding the tissue disposal section to at least double an original volume thereof.

6. The method according to claim 1 further including pulling off a lid portion of the body to expose the interior of the tissue disposal section and emptying the contents thereof.

7. The method according to claim 6 further including the step of pulling off another portion of the body to expose the interior of the tissue dispenser section and inserting fresh tissues therein.

8. The method according to claim 1 further including pulling off a portion of the body to expose the interior of the tissue dispenser section and inserting fresh tissues therein.

9. The method according to claim 8 which comprises pulling off a bottom portion of the body.

10. The method according to claim 1 further comprising pulling off a top portion of the body to expose the interior of the tissue disposal section and emptying the contents thereof, and pulling off a bottom portion of the body to expose the interior of the tissue dispenser section and inserting fresh tissues therein.

* * * * *